US006459353B1

(12) United States Patent
Mattlar et al.

(10) Patent No.: US 6,459,353 B1
(45) Date of Patent: Oct. 1, 2002

(54) HOUSING FOR FUSED SWITCH

(75) Inventors: Harri Mattlar, Iskmo; Ilmari Mäenpää, Vaasa, both of (FI)

(73) Assignee: ABB Oy, Helsinki (FI)

( * ) Notice: Subject to any disclaimer, the term of this patent is extended or adjusted under 35 U.S.C. 154(b) by 0 days.

(21) Appl. No.: 09/674,148

(22) PCT Filed: Apr. 28, 1999

(86) PCT No.: PCT/FI99/00354

§ 371 (c)(1),
(2), (4) Date: Oct. 27, 2000

(87) PCT Pub. No.: WO99/56298

PCT Pub. Date: Nov. 4, 1999

(30) Foreign Application Priority Data

Apr. 28, 1998 (FI) ..... 980933

(51) Int. Cl.[7] ..... H01H 85/044; H01H 71/20

(52) U.S. Cl. ..... 337/9; 337/143; 337/194; 337/144; 361/643; 361/642; 361/626

(58) Field of Search ..... 337/6–9, 35, 142–144, 337/186, 194, 208; 361/1, 104, 642, 643, 646, 626, 833–835, 837; 307/112, 116, 125, 131, 149

(56) References Cited

U.S. PATENT DOCUMENTS 2,137,919 A * 11/1938 Lorenz ..... 337/188
2,193,201 A * 3/1940 Millermaster ..... 337/189
3,202,775 A * 8/1965 Tillson ..... 200/336
3,202,788 A * 8/1965 George ..... 337/194
4,222,627 A 9/1980 Cox et al.
4,233,482 A * 11/1980 DiMarco et al. ..... 200/16 D
4,778,959 A * 10/1988 Sabatella et al. ..... 200/453
4,959,514 A * 9/1990 Robarge et al. ..... 218/149
5,434,376 A * 7/1995 Hyatt et al. ..... 200/293
5,945,650 A * 8/1999 Holland et al. ..... 200/15
5,969,308 A * 10/1999 Pever ..... 200/15

FOREIGN PATENT DOCUMENTS

DE 3931660 C1 * 3/1991 ..... H01H/21/16
DE 1-9738772 3/1998
EP 432652 A1 * 6/1991 ..... H01H/85/54

* cited by examiner

*Primary Examiner*—Anatoly Vortman

(57) ABSTRACT

The present invention relates to a fused switch housing (1) suited to accommodate at least one fuse adapter (2) having a first and a second contact surface (10). The fused switch housing (1) comprises a first and a second set of terminals (15) for respectively connecting the fused switch to a first and a second external circuit, stationary contacts (12, 15, 16), and at least one moving contact (13). The fused switch housing also includes switching means cooperating with each of said moving contacts (13) for making an electrical connection between each of said first terminals (15) respectively with each of said first contact surfaces (10) as well as for making an electrical connection between each of said second terminals (15) respectively with each of said second contact surfaces (10) so that at least one of said connections with said contact surfaces is openable by moving said at lest one moving contact (13) with the help of said switching means. Herein, at least one moving contact (13) is adapted to press directly against said first or second stationary contact surfaces so as to form an electrical contact.

8 Claims, 4 Drawing Sheets

HOUSING FOR FUSED SWITCH

This application is the national phase under 35 U.S.C. § 371 of PCT International Application No. PCT/FI99/00354 which has an International filing date of Apr. 28, 1999, which designated the United States of America.

BACKGROUND OF THE INVENTION

1. Field of the Invention

The present invention relates to a housing for a fused switch.

2. Description of Conventional Art

Fused switches having a fused switch housing of the type concerned herein are used, e.g., in electricity distribution, supply of electric equipment and in different types of electric circuits. The function of a fused switch is to pass electric current from a feeder circuit to a consumer circuit via at least one fuse located in the fused switch. Another function of the fused switch is to serve as a circuit breaker between the feeder and consumer circuits permitting the electric connection between said circuits to be interrupted when so required. A single fused switch can be made to connect a plurality of electric circuits to each other. For instance, a three-phase fused switch may comprise at least three first and second contact members with conductor parts connecting said members via fuses.

Conventionally, a fused switch includes at least one pair of moving contacts and a fuse connected in series. In modern fused switches the fuses are mounted in removable fuse adapters in order to ease the task of fuse replacement. This kind of switch design with a fuse adapter facilitates the use of single fused switch housing in conjunction with a number of different fuse types. Thence, only the fuse adapter need to be selected compatible with the fuse type in use. In a well-designed adapter-type fused switch, fuse replacement is also extremely safe to the person performing the operation. The fuse adapter comprises contact parts on which the fuse is easy to mount. The contact parts of the fuse adapter also act as the electrical contact between the fuse and the elements of the fused switch housing when the adapter with the fuse is inserted in place. The housing of the fused switch carries the stationary contacts with their springed contact parts serving to form an electrical contact with the mating contact parts of the fuse adapter. In the switched circuit, the stationary contacts of the switch housing located to both sides of the fuse are arranged to cooperate either on both sides with their respective moving contacts, or alternatively, so arranged that on one side the stationary contacts cooperate with the moving contacts and on the other side are directly connected to the terminals of the external circuit.

The path of current flowing through a conventional fused switch passes from the input terminals of the fused switch over the moving contact members and their contact surfaces to the stationary contacts of the switch housing, and therefrom, further over other connections to the first contact parts of the fuse adapter. Subsequent to the fuse adapter contact parts, current passes over the interface between these contact parts and those of the fuse proper, and then over the second, similar fuse contact interface to the second contact parts of the fuse adapter. Prior to reaching the output terminals of the fused switch, the current must pass at least the contact interface between the second contact parts of the fuse adapter and the second stationary contact parts of the fused switch. Resultingly, each current path of conventional fused switches contains at least four connections/contacts on the fuse and switch side of the fuse adapter plus the internal connections of the switch itself.

The number and quality of connections in a fused switch affect the properties of the fused switch. This is because each connection involves a separate interface resistance that in turn causes additional heating of the fused switch and thus reduces its load rating. Furthermore, the fabrication of any single connection is a separate cost factor and each connection is a potential origin of malfunction. Another aspect affecting the current breaking capacity of a switch is essentially related to the number and operating speed of current-breaking connections provided on the current path. The greater the number of simultaneously operating air gaps in series the faster the switch can quench a possible arc striking between the contact surfaces of opening switch members. Arcing causes undesirable wear in the switch and generates interference in the form of electromagnetic radiation, for instance. The quenching properties of the contact gap arc are particularly important in DC switches. AC switches are not so critical in this sense inasmuch the current passing in an AC circuit over an arc inherently crosses zero twice during each cycle.

Hence, the type and number of contacts acting as opening gaps in a fused switch must be designed chiefly on the basis of their current-breaking properties. In turn, the number of connections not participating in current turn-off should be minimized.

Prior-art technology of fuse-adapter-type fused switches is handicapped by having at least four connections per each current path suck that they do not participate in the actual switching operation.

SUMMARY OF THE INVENTION

It is an object of the invention to provide an entirely new type of housing for a fused switch, wherein redundant connections are eliminated.

The goal of the invention is achieved by a switch design having at least some of the fuse adapter contact surfaces which face those of the switch housing and make the electrical connections between the fuse and the switch housing to additionally perform as opening/closing contacts of the switch. Accordingly, the invention is based on combining at least one of two connections which make the electrical connections between the fuse and the switch housing with its series-connected opening/closing contact so as to form a single contact-type connection.

The invention offers significant benefits.

With the exception of fuse connections, the fused switch according to the invention need not necessarily have any such internal connections that do not participate with the circuit switching functions. The connections between the fuses and contact parts of the fuse adapter are required for implementing the adapter-type fused switch design. Hence, with the aid of the invention, unnecessary connections in the present fused switch construction are disposed of.

BRIEF DESCRIPTION OF THE DRAWINGS

The invention makes it possible to reduce the heating of the fused switch under electrical load thus improving the load rating of the switch. The simple construction of the fused switch is also more reliable in service and more cost-effective to produce.

DETAILED DESCRIPTION

Figure 1:
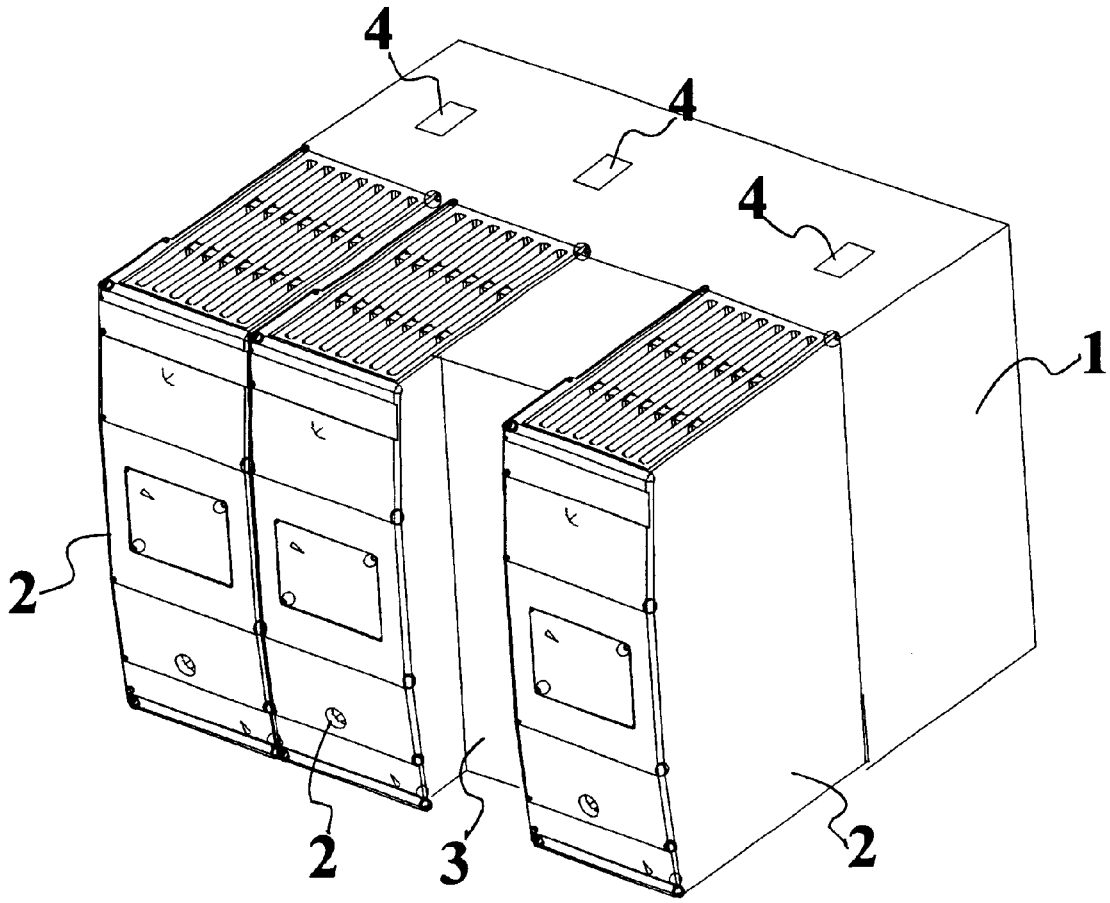
FIG. 1 shows a fused switch design according to the invention in a view taken obliquely from above.

In FIG. 1 is shown a fused switch suitable for controlling a three-phase circuit. The fused switch comprises a fused switch housing 1, and connected to the fused switch housing 1, three parallel-mounted fuse adapters 2 which form a portion of the front surface of the fused switch. Additionally, the fused switch front surface comprises a control slot 3 amidst two fuse adapters 2 for mounting a control device (not shown) on the fused switch. The control device makes it possible to open or close the switch contacts. In practice, the control device can be, e.g., a handle.

The upper surface of the fused switch housing 1 has a set of three terminals 4 for connecting the fused switch to a first external circuit which may be either a feeder circuit or a consumer circuit. The bottom side of the fused switch housing 1 has a second set of corresponding terminals for connecting the fused switch to a second external circuit. In the fused switch embodiment shown in the diagram, the first and second sets of terminals 4 are connected to the fuse adapter 2 via the contact parts so that two opening contact gaps are provided on both sides between the terminal sets and the fuse adapter 2. In this type of device, there is no difference whether the terminals 4 of the upper or lower surface are connected to the consumer circuit. If the opening contact gaps are provided only between the second set of terminals 4 and the fuse adapter 2, reasons of safety dictate that the feeder circuit should preferably be connected to those terminals 4 that are connected to the conductors of the fuse adapters 2 via the opening/closing contacts.

Figure 2:
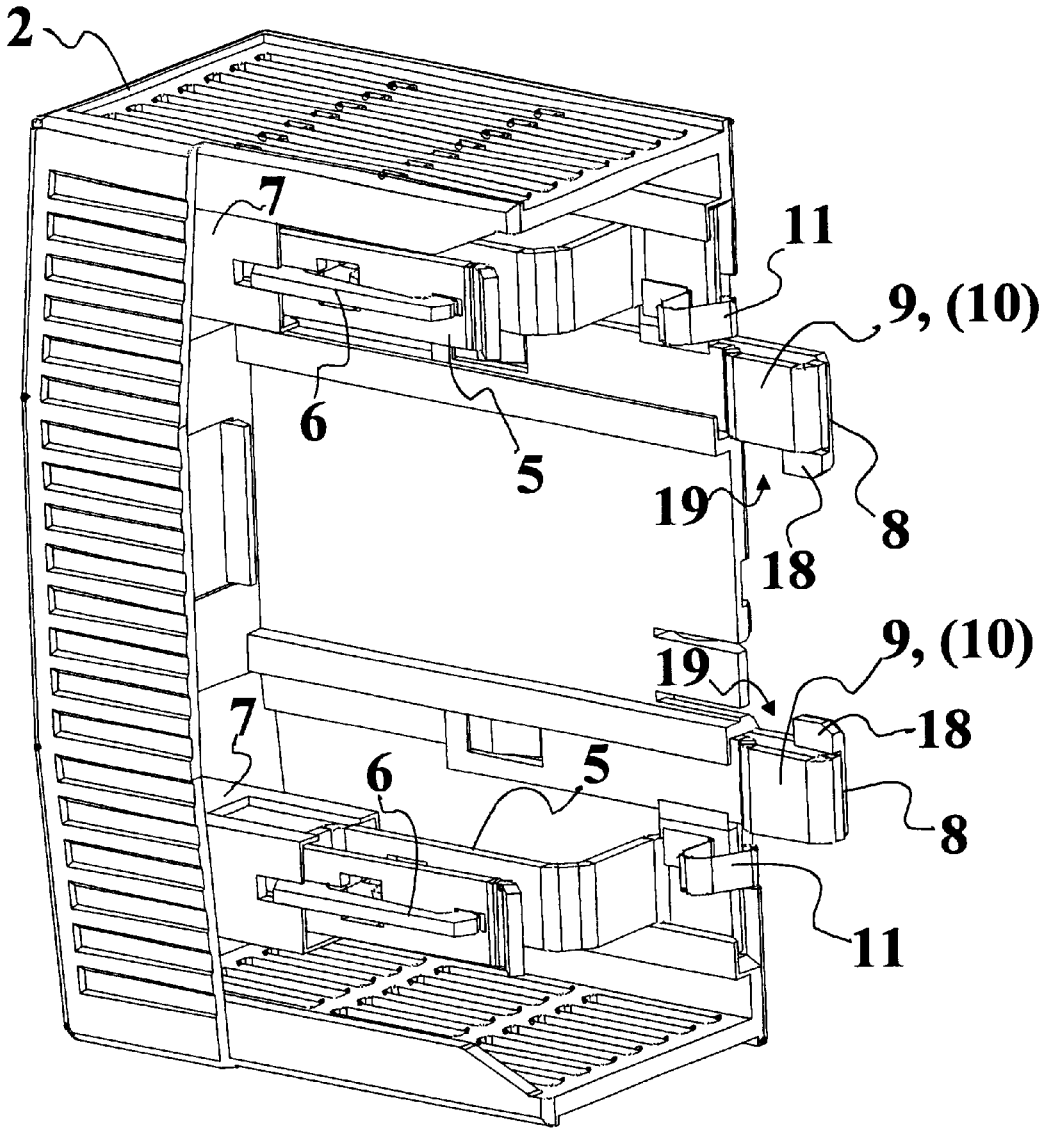
FIG. 2 shows a removable fuse adapter suitable for use in the fused switch illustrated in FIG. 1.
Figure 3:
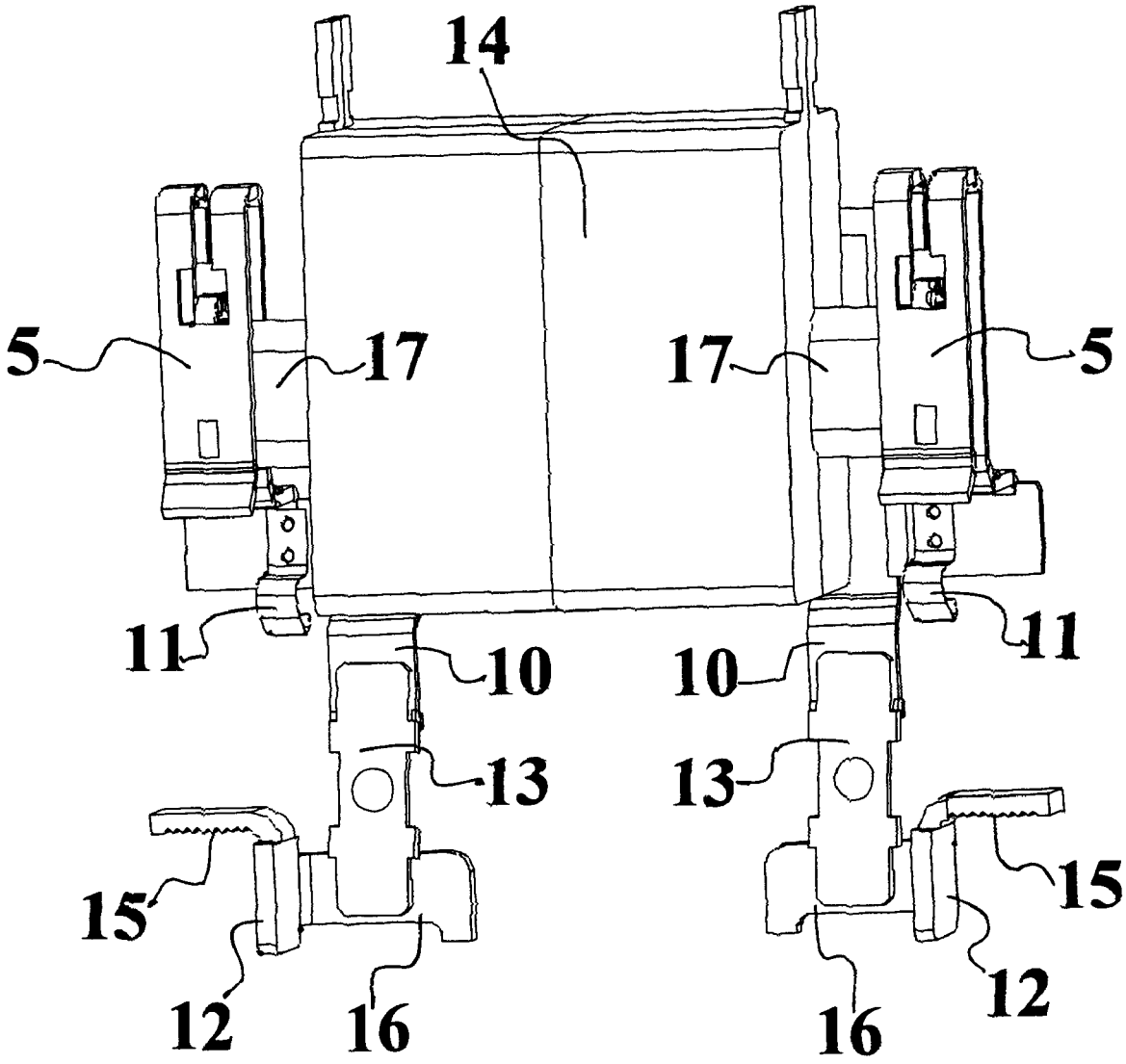
FIG. 3 shows one current path in a fused switch according to the invention.
Figure 4:
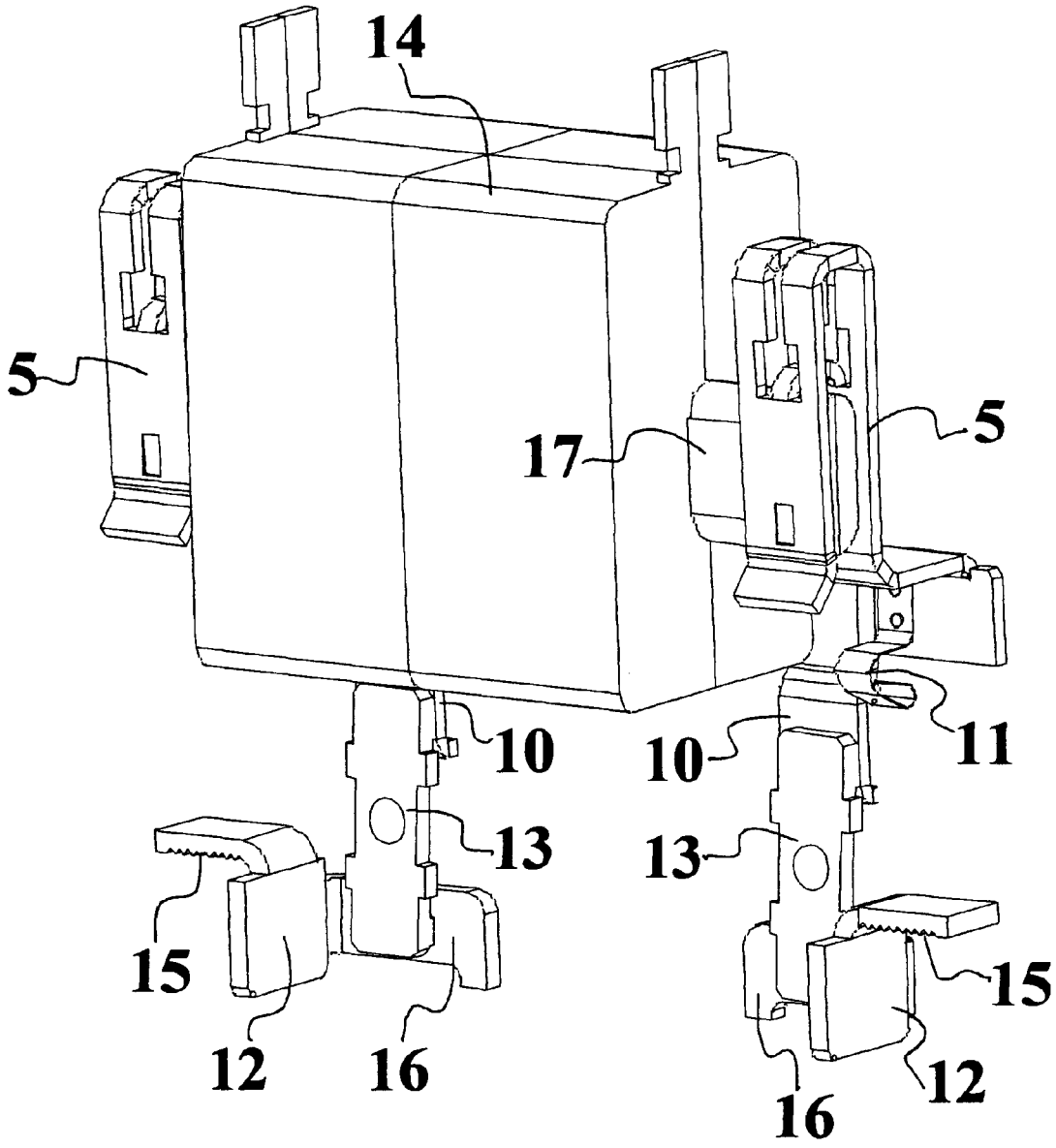
FIG. 4 shows the current path of FIG. 3 in a view taken obliquely from above.

FIG. 2 shows the removable fuse adapter 2 of the fused switch in a view taken obliquely from behind the switch. The diagram illustrates the fuse holder clips 5 made from a conducting material such as copper. The first end of each fuse holder clip 5 is so bent that it forms a clinching leaf spring slot suited to accommodate the ferrule 17 of the fuse 14 (FIGS. 3 and 4). The fuse holder clips 5 are complemented with springs 6 serving to press the contact surfaces of the fuse holder clip 5 against the ferrule 17 of the fuse 14 (FIGS. 3 and 4) thus assuring a good electrical contact. The fuse holder grips 5 are mounted on the fuse adapter 2 which is made from a dielectric material such as a plastic. The first ends of the fuse holder clips 5 are supported on the fuse adapter 2 by appropriately shaped support brackets 7.

The second ends of the fuse holder clips 5 are supported by contact support projections 8 made on the fuse adapter 2. The contact support projections 8 and the fused switch housing 1 have such a compatible design that when the fuse adapter 2 is mounted in place, the contact support projections 8 will be inserted through openings made to the fused switch housing 1 so as to protrude into the interior of the fused switch housing 1. Thence, the second ends of the fuse holder clips 5 form on the surface of the contact support projections 8 such contact surfaces 9 that after their insertion into the interior of the fused switch housing 1 can act as the first set of contact surfaces 10. On the contact support projections 8 are also made stops 18 with cavities 19 remaining behind the same. In the diagram are also illustrated spring-leaf type auxiliary contacts 11 of a conducting material that are electrically connected to the fuse holder clips 5. The function of the auxiliary contacts 11 is to make an electrical connection from both ferrules of the fuse and to the fuse condition monitoring terminals of the fused switch. Thus, the auxiliary contacts facilitate a fuse continuity test without any need for removing the fuse from the fused switch.

FIG. 3 shows those parts of the fused switch that participate in the formation of a current path through the fused switch. The same parts are shown in FIG. 4 in a view taken slightly obliquely from above. The current path is formed by two stationary contacts 12, two moving contacts 13, two fuse holder clips 5 and the fuse 14. The stationary contact 12 is a member made of a conducting material whose first end extends up to the terminal 4 (FIG. 1) so as to form the lug 15 of the terminal 14. The second end of the stationary contact 12 extends at a distance from the contact support projection 8 (FIG. 2) of the mounted fuse adapter 2 thus forming a second set of contact surfaces 16 aligned essentially parallel to the first set of contact surfaces 10. The shape of the moving contact 13 is made compatible with the contact surfaces 10, 16 such that it facilitates the formation of an electrical connection between said contact surfaces 10, 16.

The moving contacts 13 can be actuated by means of conventional switching members capable of actuating the moving contacts 13 in a spring-loaded manner from one position to another. Such switching members may comprise, e.g, springs connected to the moving contacts 13, trigger elements limiting the movement of the moving contacts 13 and a handle serving to control the movement of the switching members and to transmit the switch actuating energy to the switching members. To open the switch, the handle must be rotated, whereby energy is stored in the actuating springs. After the handle is rotated sufficiently far, the trigger elements release the moving contacts 13 into a fast movement apart from the stationary contact surfaces 10, 16. This arrangement serves to shorten the duration of arcing between the contacts. In the closing operation of the switch, the trigger elements function in a similar manner, but now in a reverse direction.

The switching members may also include interlock cams (not shown) that cooperate with the moving contacts 13 or alternatively, with other parts moving along with the same, such as the support/control elements of the moving contacts 13. The function of these interlock cams is to prevent the mounting/dismounting of the fuse adapter 2 in place in the fused switch when the switch is in its closed position. This arrangement serves to prevent the closure/disconnection of a circuit by means of manual insertion/withdrawal of the fuse adapter 2. Due to the slow speed of manual circuit connection/disconnection, the result might be a long-lasting arc in both or only one contact gap between the fuse holder clip 5 and its respective moving contact 13. Such an arc could be hazardous for both the switch and the person operating the same.

Accordingly, the interlock cam is arranged to follow the movement of the moving contact 13. In the exemplifying embodiment, the interlock cam is so disposed and shaped that in the closed position of the fused switch, the cam extends past that contact surface of the moving contact 13 which is adapted to cooperate with the first contact surface 10, whereby the cam passes over that edge of the moving contact which faces the fuse adapter 2. Thus, when the fuse adapter 2 is properly inserted to the fused switch housing, the cam can enter a recess 19 which, when viewed from the fused switch housing 1 towards the fuse adapter 2, is left behind a stop 18 in the contact support projection 8. Now, if an attempt is made to remove the fuse adapter 2, the stop 18 meets the cam thus preventing the removal of the fuse adapter 2. Respectively, in a situation in which the switch is closed and the fuse adapter 2 is removed, the cam meets the stop 18 thus preventing the mounting of the fuse adapter 2 into the fused switch when the latter is in its closed position.

When the switch is turned into its open position, the cam is withdrawn along with the moving contacts 13 from the vicinity of the contact surfaces 10, 16, thus permitting the mounting and dismounting of the fuse adapter 2 without the interlock function of the cam and the stop 18. Advantageously, the cam and the stop 18 are made from a dielectric material.

Accordingly, the fused switch embodiment shown in FIGS. 3 and 4 has a total number of six internal connections. Obviously necessary are also the feeder and consumer circuit connections at the contact surfaces 15 of the terminals 4. Hence, four of the six internal connections can simultaneously act as opening/closing contact gaps. These opening/closing contacts are formed by the connections between the first contact surfaces 10 and the moving contacts 13, and respectively, between the second contact surfaces 16 and the moving contacts 13. The non-opening connections are required only between the fuse holder clips 5 and the ferrules 17 of the fuses 14. These two connections not participating in the switching functions are necessary to assure an easy and safe fuse change and to guarantee reliable function of the opening/closing contact gaps.

Without departing from the scope and spirit of the invention, also embodiments different from those described above may be contemplated. For instance, the number of series-connected contacts with their mating contact surfaces on each current path can be increased from that mentioned in the described embodiments. Alternatively, the number of opening/closing contact gaps can be reduced, which means that the switch can be implemented using one, two or three opening/closing contact gaps. Herein, a hinged-type switch construction could be contemplated with a single opening/closing contact gap adapted to operate on at least one side of the fuse. Then, the other end of the contact member could be taken directly to the input/output terminal of the external circuit. This type of a switch with a single opening/ closing contact gap could be readily implemented using a flexible conducting member. The moving contacts can also be of the knife-blade type.

What is claimed is:

1. Fused switch housing suited to accommodate at least one removable fuse adapter having a first and a second contact surface, said fused switch housing comprising first and second terminals for connecting the fused switch to a first and a second external circuit, and stationary contacts, at least one moving contact and switching means cooperating with each of said moving contacts, said elements serving to make an electrical connection between said first terminals and said first contact surface as well as to make an electrical connection between sad second terminals and said second contact surface so that at least one of said connections is openable by moving said at least one moving contact with the help of said switching means, for making said electrical contact, said at least one moving contact is configured to press against such a first contact surface which simultaneously acts as said first or second contact surface of the fuse adapter mounted in said fused switch housing.

2. Fused switch housing according to claim 1, wherein the first end of said at least one stationary contact includes a connection surface of the terminal and the second end of the same includes a second contact surface against which said moving contact is configured to press for forming an electrical connection between said first contact surface and said second contact surface.

3. Fused switch housing (1) according to claim 2, wherein the current path from said connection surface of said first terminal to the surface of said moving contact configured to press against said first contact surface is formed by a stationary contact, the contact formed between said second contact surface and said moving contact, a moving contact.

4. Fused switch housing according to claim 2, wherein said switch housing comprises a second moving contact and such a second stationary contact whose one end forms a connection surface of the second terminal and the other end forms another second contact surface against which said second moving contact is configured to press for forming an electrical connection between another first contact surface and said another second contact surface.

5. Fused switch housing according to claim 4, wherein said switching means are configured to move each of said moving contacts substantially simultaneously when the electrical contacts are closed and opened.

6. Fused switch housing according to claim 1, further comprising first and second contacts in sets of three terminals, stationary contacts connected to said sets of first and second contacts, and moving contacts configured to press at least against the contact surface of said stationary contact (12) connected to said first terminal.

7. Fused switch housing according to claim 1, wherein per each moving contact there is provided at least one interlock cam configured to move along with said moving contact, said cam being configured to extend, in a direction which is the same as the insertion mounting direction of the fuse adapter, past that contact surface of the moving contact which is configured to cooperate with said first contact surface.

8. Fuse adapter for use in conjunction with the fused switch housing according to claim 7, said fuse adapter comprising a fuse adapter housing with two contact support projections configured to extend into the interior of said fused switch housing, and two conducting fuse holder clips mounted in said fuse adapter housing, whereby the first ends of said fuse holder clips are configured to provide electrical contacts mating with the ferrules of a fuse and the second ends thereof to extend as far as to the surface of said contact support projections so as to form contact surfaces, wherein said contact support projections are provided per each moving contact with at least one stop configured to cooperate with said cam moving along with said moving contact so as to prevent the mounting of said fuse adapter into said fused switch housing or alternatively, dismounting the same from said fused switch housing when said moving contact is switched into its closed position.

* * * * *